US008087336B2

(12) United States Patent
Fleischer et al.

(10) Patent No.: US 8,087,336 B2
(45) Date of Patent: Jan. 3, 2012

(54) ROTATING AND SLIDING HATCH DOOR FOR A LAUNCHER SYSTEM

(75) Inventors: Corey A. Fleischer, Columbia, MD (US); Bruce S. Chiu, Baltimore, MD (US); Kristopher Heick, Baltimore, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 366 days.

(21) Appl. No.: 12/266,445

(22) Filed: Nov. 6, 2008

(65) Prior Publication Data

US 2010/0282051 A1 Nov. 11, 2010

(51) Int. Cl.
*F41F 3/04* (2006.01)
*B63B 19/18* (2006.01)

(52) U.S. Cl. ..... 89/1.8; 114/202; 114/203; 296/155; 296/146.4; 49/356; 49/357

(58) Field of Classification Search ..... 89/1.8, 89/1.817; 114/201, 202, 203; 296/155, 146.4; 49/356, 357
See application file for complete search history.

(56) References Cited

U.S. PATENT DOCUMENTS

| | | | | |
|---|---|---|---|---|
| 2,071,203 | A | | 2/1937 | Hubbs |
| 2,108,289 | A | | 2/1938 | Laddon |
| 2,664,947 | A | | 1/1954 | Reinhardt |
| 3,077,225 | A | | 2/1963 | Reinhardt |
| 3,312,990 | A | | 4/1967 | Lapworth |
| 3,480,247 | A | | 11/1969 | Waner |
| 3,513,799 | A | | 5/1970 | Beas |
| 3,861,083 | A | | 1/1975 | Goiot |
| 3,934,383 | A | | 1/1976 | Perry et al. |
| 3,976,024 | A | | 8/1976 | Fillery |
| 4,215,885 | A | | 8/1980 | McCray |
| 4,263,863 | A | | 4/1981 | Leitch |
| 4,300,440 | A | | 11/1981 | Holter |
| 4,301,708 | A | * | 11/1981 | Mussey ..... 89/1.81 |
| 4,934,241 | A | * | 6/1990 | Piesik ..... 89/1.817 |
| 5,153,367 | A | * | 10/1992 | Markquart et al. ..... 89/1.816 |
| 5,162,605 | A | * | 11/1992 | Piesik ..... 89/1.817 |
| 5,837,917 | A | * | 11/1998 | Macnab et al. ..... 89/1.8 |
| 5,983,819 | A | | 11/1999 | Kyle |
| 6,105,529 | A | | 8/2000 | Kyle |
| 6,230,604 | B1 | * | 5/2001 | Larson et al. ..... 89/1.817 |
| 6,679,454 | B2 | * | 1/2004 | Olsen et al. ..... 244/137.1 |

(Continued)

FOREIGN PATENT DOCUMENTS

EP 0438650 7/1991

*Primary Examiner* — Michael David
(74) *Attorney, Agent, or Firm* — Kevin D. Jablonski; Graybeal Jackson LLP

(57) ABSTRACT

A system and method for actuating a hatch door. One embodiment includes a vertical launcher system that has a hatch door disposed in a plane at the top of a hold. The hatch door includes a leading edge and a trailing edge at opposite ends of the hatch door. When an actuator arm for maneuvering the hatch door is extended, the leading edge is lifted away from the plane by the actuator arm while the trailing edge remains in the plane and slides across the top of the plane toward the point where the leading edge was first lifted away. Such a sliding hatch mechanism allows for quick opening and closing of a hatch door while providing more efficient use of mechanical energy for breaking ice build up or prevent intrusion.

13 Claims, 3 Drawing Sheets

U.S. PATENT DOCUMENTS 6,755,111 B2 * 6/2004 Ciappi ..... 89/1.817
7,073,213 B2 7/2006 Duarte et al.
7,591,504 B1 * 9/2009 Schrader ..... 296/202
7,611,190 B1 * 11/2009 Elliott et al. ..... 296/155
7,686,378 B2 * 3/2010 Gisler et al. ..... 296/146.4
7,765,740 B2 * 8/2010 Heuel et al. ..... 49/360
2006/0086241 A1 * 4/2006 Miller et al. ..... 89/1.802
2009/0273207 A1 * 11/2009 Lewis et al. ..... 296/190.11
2010/0236391 A1 * 9/2010 Baldi et al. ..... 89/1.815

* cited by examiner

ROTATING AND SLIDING HATCH DOOR FOR A LAUNCHER SYSTEM

BACKGROUND

Aircraft, ships, special-use vehicles, and other vessels may have hatches with hatch doors that may be opened and closed for various uses. For example, a land-based vehicle with a rocket-launch bay may have an external hatch with a movable door that may be opened and closed. As another example, a water vessel may have a missile-launch hatch with a movable hatch door that may open when the missile is to be launched and closed when the missile is to remain in the hatch. Such hatch doors help protect the munitions in the hatch secure from the elements and would-be intruders.

FIG. 1 is a diagram of a conventional vertical launcher system 100, which may be installed in a vessel and which includes a launch cell 110, a hatch door 115 and a hatch-door actuating system 116. When closed, the hatch door 115 (which is shown in an open position in FIG. 1) covers a hold 112 that may be suitable for holding munitions, such as a rocket or missile (not shown). The system 116 may move the hatch door 115 from a closed position (e.g., from a position that covers the hold 112) to an open position (e.g., exposing the hold 112) and vice versa.

Often times, a vessel with such a vertical launch system 100 may be deployed in harsh environments with cold temperatures, and this may result in ice buildup on and around the hatch door 115. If the ice buildup is great enough, the actuation of the hatch door 115 may be compromised. Other environments may cause a buildup of rust that also may prevent the hatch door 115 from actuating properly. Additionally, such a vessel may be the target of intruders and enemies that may wish to obtain the munitions stored in the hold 112. Thus, the system 100 may also include an anti-intrusion mechanism that prevents would-be intruders from externally opening the hatch door 115.

Taking into account the foregoing parameters, the actuating system 116 of the conventional system 100 includes a gear box 130 that drives a linkage system 125 to rotate the hatch door 115 about a trailing edge 120, which is the edge of the hatch door 115 that remains near a plane at the top of the launch cell 110 as the hatch door is actuated. This is in contrast to a hatch door's leading edge 121, which is the end of the hatch door 115 that rotates upward and away from the plane at the top of the hatch 110 when the hatch door is opened The hatch door 115 may be actuated along a curved path 150 by using the actuating system 116 to rotate the hatch door 115 about the trailing edge 120. The trailing edge 120 of the hatch door 115 is rotatably fixed at this point. Thus, when opening the hatch door 115, the hatch door 115 swings up along the curved path 150 about the rotation point at the trailing edge 120. Likewise, when closing the hatch door 115, the hatch door 115 swings down along the curved path 150 about the rotation point at the trailing edge 120 as well.

Because of the nature of actuating the hatch door 115 at the trailing edge 120, the linkage 125 may not be well suited to provide a rotational moment in a lateral manner. That is, using the conventional actuating system 116 to transfer lateral movement to a rotational moment at the trailing edge 120 is not an efficient use of mechanical advantage. Such conventional mechanisms are not an efficient use of material to handle the aforementioned ice or rust buildup.

Further, the conventional actuator system 116 may employ elaborate system of rockers and cams (not shown in detail) to provide anti-intrusion measures that prevent the hatch door 115 from being pried open externally.

BRIEF DESCRIPTION OF THE DRAWINGS

Various aspects and attendant advantages of the subject matter disclosed herein will become more readily appreciated as the same become better understood by reference to the following detailed description, when taken in conjunction with the accompanying drawings, wherein.

DETAILED DESCRIPTION

The following discussion is presented to enable a person skilled in the art to make and use the subject matter disclosed herein. The general principles described herein may be applied to embodiments and applications other than those detailed above without departing from the spirit and scope of the subject matter disclosed herein. This disclosure is not intended to be limited to the embodiments shown, but is to be accorded the widest scope consistent with the principles and features disclosed or suggested herein.

Figure 2A:
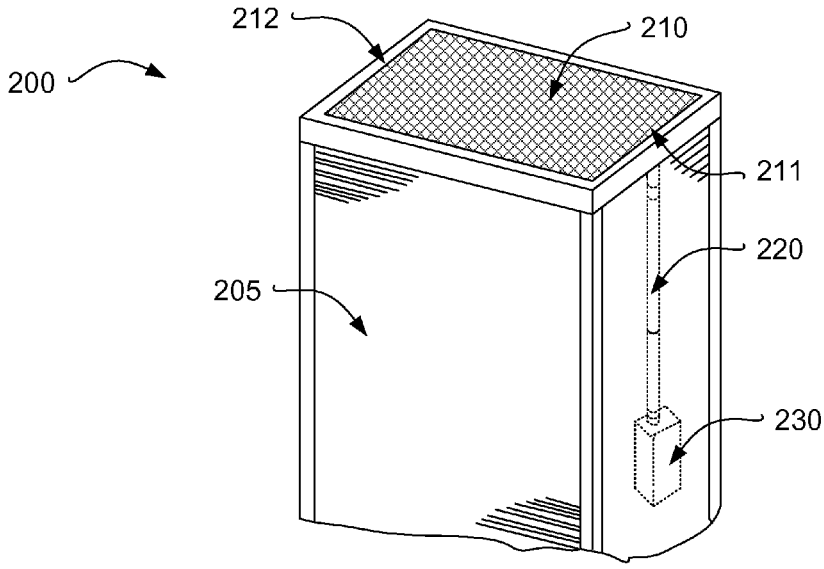
FIGS. 2*a-c* are a series of isometric views of a vertical-launcher system that includes a hold, a hatch door, and a subsystem for actuating the hatch door according to an embodiment of the subject matter disclosed herein.
Figure 2B:
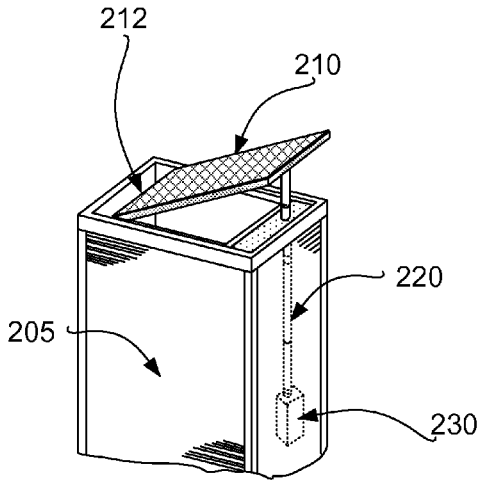
Figure 2C:
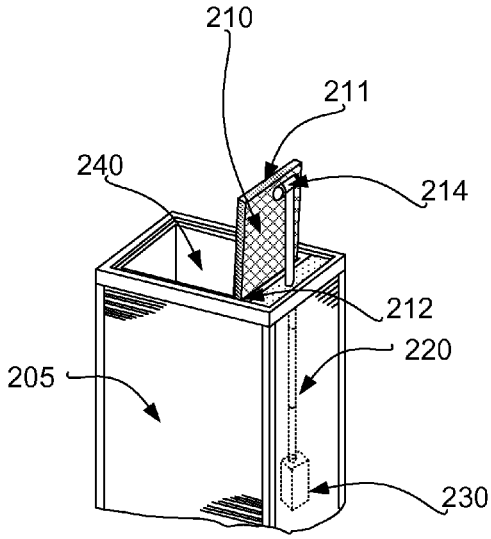

FIGS. 2*a-c* are a series of isometric views of a vertical-launcher system 200 having a subsystem for actuating a hatch door 210 according to an embodiment of the subject matter disclosed herein. Referring first to FIG. 2*a*, such a system 200 may be installed on any one of, e.g., a land-based vehicle, aircraft, or a water vessel, and includes a vertical hold 205, (sometimes referred to as a launch cell) which may be suitable for housing munitions such as a rocket or missile (not shown). But also contemplated are other embodiments of the vertical launcher system 200 for non-munitions apparatuses such as an unmanned aircraft drone, unmanned probe vessels, and the like.

The launcher system 200 also includes a hatch door 210 disposed in a frame (shown as substantially the exterior outline of the hatch door) which is shown in a closed position in FIG. 2*a*. The hatch door 210 covers the hold 205, and may be actuated from a closed position (e.g., wherein the hold 205 is covered) to an open position (e.g., wherein the hold 205 is covered) and vice versa. Although shown as substantially rectangular, the hatch door 210 may be other shapes and sizes, e.g., circular or rounded.

As described above, such a launcher system 200 may be disposed on a vehicle that may be deployed in harsh environments with cold conditions that may result in, e.g., ice buildup, corrosion, or rust on the hatch door 210. Additionally, such vehicles may be the target of intruders that may wish to obtain any munitions stored in the hold 205.

Therefore, the system 200 includes an actuator 230 coupled to an actuator arm 220 (both the actuator and arm are inside the hold 205, and thus are shown in dashed line), which is designed to move the actuator arm 220 in a vertical direction (i.e., parallel with the hold 205). Further, the actuator arm 220 is coupled to the hatch door 210 at a first end referred to as a leading edge 211, while a second end referred to as a trailing edge 212 of the hatch door 210 is at an opposite side of the hold 205. When the hatch door 210 is in the closed position, both the leading edge 211 and the trailing edge 212 are disposed in the same plane at the top of the hold 205 which may be the frame of the hatch door 210.

FIG. 2*b* shows the hatch door 210 in a partially-actuated position during an opening (or closing) maneuver. The hatch door 210 may be secured in a closed position or maneuvered to an open position by the actuator 230. Thus, as shown in FIG. 2*b*, when the actuator 230 begins to open the hatch door 210, the actuator arm 220 pushes up against the leading edge 211 of the hatch door 210 and lifts the hatch door 210 away from the hatch 205. The lifting of the leading edge 211 causes the hatch door 210 to open initially around a rotational point at the trailing edge 212. This is because the trailing edge 212 remains secured in the plane at the top of the hold 205 but in a slidable manner.

The trailing edge 212 of the hatch door 210 is attached to this initial rotational point in a manner that still allows for horizontal sliding substantially along the plane at the top of the hold 205. In one embodiment, the trailing edge 212 of the hatch door 210 may be slidably secured to the plane at the top of the hold 205 using a tongue and groove arrangement. Thus, as the actuator arm 230 extends, the leading edge 211 of the hatch door 210 is pushed higher, while the trailing edge 212 slides toward the opposite side of the hold top. As the trailing edge 212 is drawn closer to the opposite side of the hold 205, more of the hold interior is exposed. In one embodiment, the sliding movement of the trailing edge is facilitated by a wheeled track or glider apparatus (not shown in detail).

FIG. 2*c* shows the hatch door 210 in a fully-actuated, open position. When open, the actuator arm 220 is extended to a full extension such that the hatch door 210 is substantially vertical, with the leading edge 211 at an upper-most position. As can be seen in this view, the actuator arm 220 is coupled to the hatch door 210 at a rotatable coupling point 214 that allows for the hatch door 210 to rotate about this coupling point 214 when being maneuvered. The trailing edge 212 remains at the bottom position and still in the plane at the top of the hold 205. When in the fully open position, the trailing edge 212 is also all the way over to the opposite side of the top of the hold 205 such that the hold 240 is fully exposed. As a result, any munitions stored in the hold 205, such as a rocket or missile, may now be launched.

With such a system 200, the actuator is able to apply a force to the hatch door 210 that is not at the point of rotation (i.e., not at the trailing edge 212). By applying the actuation force directly to the leading edge 211, the full force of the actuator may be applied to breaking ice buildup or rust. This is an advantage over conventional system that would not apply the full force of the actuator as the conventional linkage system introduces a significant mechanical disadvantage.

In a similar, yet opposite manner, once any munitions in the vertical hold 205 have been launched or otherwise removed (or a decision not to launch/remove has been reached) the hatch door 210 may be closed. This is accomplished by retracting the actuator arm 220 with the actuator 230. This causes the trailing edge 212 to travel back across the plane at the top of the hold 205 and return to its original side of the hatch 205. Likewise, the leading edge 211 also returns to the plane at the top of the hold 205 and the opening 240 is once again covered by the hatch door 210.

Figure 1:
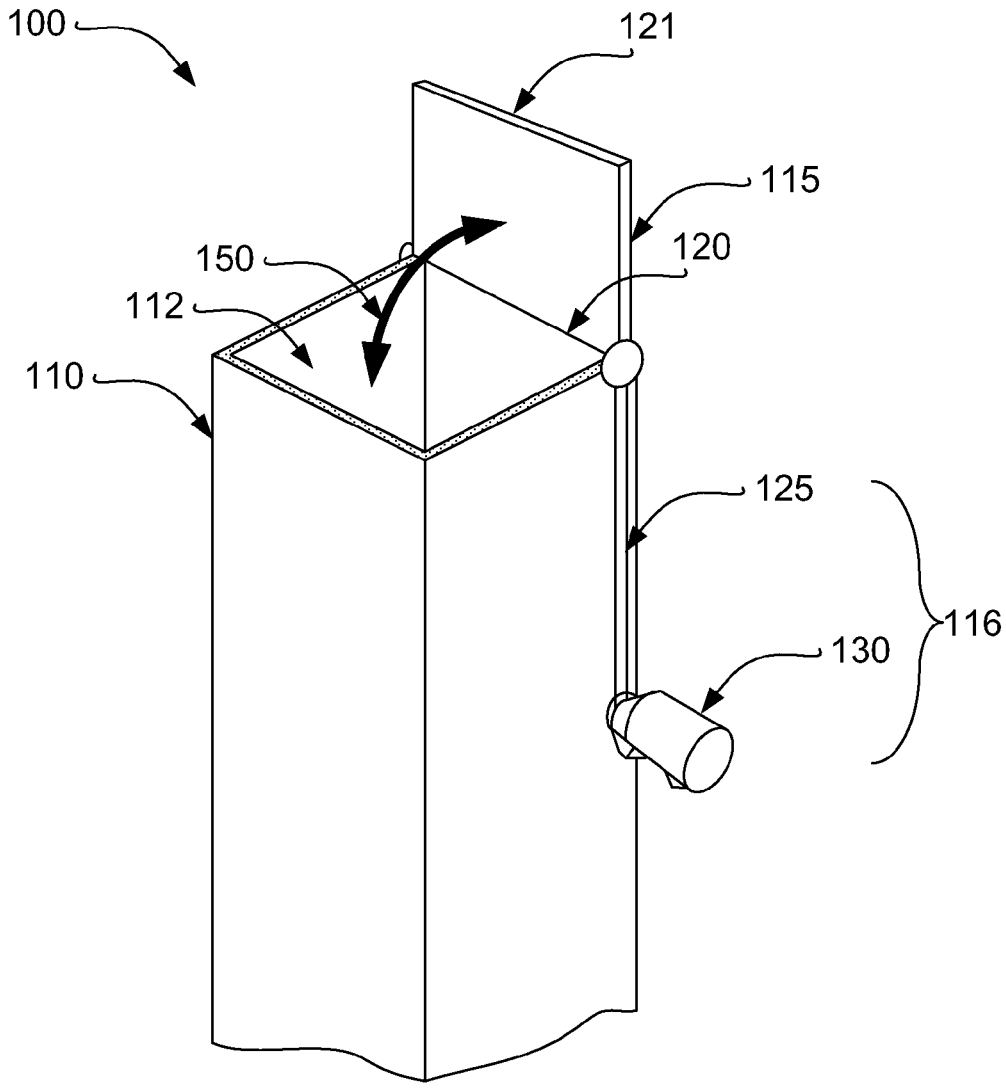
FIG. 1 (PRIOR ART)
FIG. 1 is a diagram of a conventional vertical launcher system.

The actuator 230 may be an electric motor actuator, a pneumatic motor actuator (which is often configured in a cylindrical shape), a hydraulic actuator, a magnetic-energy actuator or any suitable device capable of vertically moving the actuator arm 220 with sufficient force. Further, there may be more than one actuator disposed in the system to facilitate the movement of the hatch door 210. Having an actuator arm 220 that moves in the vertical direction provides better anti-intrusion measures as externally prying open the hatch door 210 is more difficult. That is, the actuator 230, when not in use, holds the hatch door 210 in the closed, seated position and provides better resistance than the gear box 130 and linkage system 125 of the conventional system 100 of FIG. 1. Further, the actuator 230 may apply an additional seating force (e.g., a force that pulls down in a vertical direction on the leading edge 211 of the hatch door 210) for seating the hatch door 210 over the hold 205 when in the closed position. The seating may also include a rubber gasket to provide a fluid-tight or air-tight seal as may be required by the vessel in which the system is deployed. Further yet, such a sealing force may also reduce or eliminate the need for a secondary anti-intrusion system or may be applied to help break ice-buildup prior to attempting to open the hatch door 210. Additionally, the reduction of components and materials (from the conventional system with rockers and cams) may provide significant cost and weight savings to the entire vertical launcher system 200.

When opened fully, the hatch door 210 may be designed to withstand various forces such as wind drag, missile plume, water wave crash, external ballistics, and gun blasts. Further, in an embodiment, the opening (or closing) maneuver may be accomplished in approximately 1.3 seconds. In yet other embodiments, the actuator 230 may be disposed inside the hold 205 such that its operation does not interfere with the launching of any munitions in the hold. Alternatively, the actuator 230 may be externally attached the hold 205.

Figures 3A, 3B, 3C:
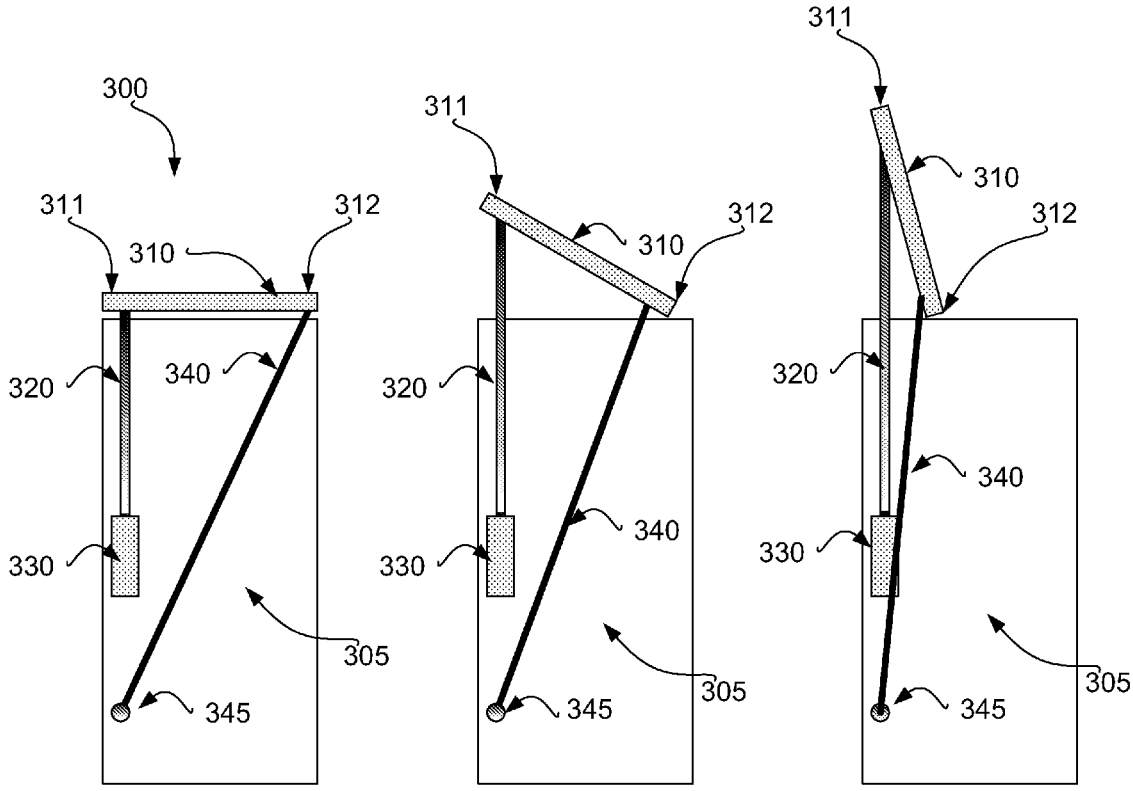
FIGS. 3*a-c* are a corresponding series of cut-away side views of a vertical launcher system including a hatch-door having a guiding linkage according to an embodiment of the subject matter disclosed herein.

FIGS. 3*a-c* are a series of cut-away side views of a vertical launcher system 300 that includes a hatch door 310 having a guiding linkage arm 340 according to an embodiment of the subject matter disclosed herein. The vertical launcher system 300 of FIGS. 3*a-c* is similar to the vertical launcher system 200 of FIGS. 2*a-c* but having an additional subsystem for facilitating the maneuvering of a hatch door. Such a guiding linkage arm 340 may be of a telescoping nature such that the length from one end to the other is adjustable as the guiding linkage arm 340 is maneuvered. In another embodiment, the guiding linkage arm 340 may be a biased spring member that maintains a force pulling down or pushing up on the trailing edge 312 of the hatch door 310.

Referring first to FIG. 3*a*, the system 300 is shown with the hatch door 310 in a closed position and disposed in a plane at the top of the hold 305. The actuator arm 320 is fully retracted and the leading edge 311 and trailing edge 312 of the hatch door are in same plane at the top of the hold 305. In this embodiment, the system 300 includes a guiding linkage arm 340 that is rotatably attached to both the trailing edge 312 of the hatch door 310 and to a coupling point 345 that is disposed below the actuator 330. The coupling point may be disposed within or outside of the hold 305. The linkage arm 340 helps facilitate the maneuvering of the hatch door 310 as the actuator 330 extends and retracts the actuator arm 320.

FIG. 3*b* shows the hatch door 310 at a partially-actuated position point in being opened (or being closed). The actuator 330 extends the actuator arm 320 upward such that the leading edge 311 of the hatch door 310 is lifted away from the plane at the top of the hatch door 310. Further, the trailing edge 312 of the hatch door 310 remains in the plane (e.g., the trailing edge is slidably secured within this plane) at the top of the hold 305 as assisted by the linkage arm 340. As the hatch door 310 continues to open, the leading edge 311 of a hatch door 310 continues to rise while the trailing edge 312 of the hatch door 310 continues to move in the plane toward the actuator arm 320 as the linkage arm 340 rotates about the coupling point 345. The linkage arm, being extendable and retractable, begins to retract during this maneuvering.

FIG. 3*c* shows the hatch door 310 near the fully open position wherein the leading edge 311 is near the upper-most position as the actuator arm 320 is nearly at full extension. The hatch door 310 is substantially vertical at this point as the trailing edge 312 is maneuvered to the opposite side of the hatch 305 (in relation to where the trailing edge 312 started in the closed position) while remaining in the plane at the top of the hatch 305. Again, the linkage arm 340 remains rotatably attached to the trailing edge 312 of the hatch door 310 and rotates about the coupling point 345. Such rotatable couplings help facilitate the opening and closing of the hatch door 310.

Further, since the guiding linkage arm 340 is adjustable in length, the trailing edge 312 movement of the hatch door 310 is facilitated further by the retractable (during opening) and extendable (during closing) nature of the guiding linkage arm 340. In one embodiment, the guiding linkage arm 340 may be spring loaded to assist in the opening or closing of the hatch door 310 by providing additional bias for opening or closing. In one embodiment may be providing for both opening and closing. Thus, when opening, the guiding linkage provides an assistive force up until the hatch door 310 passes a partially-actuated position and an assistive force when closing up until the same partially-actuated position on the way back when closing. Further, the guiding linkage system may include a air-piston/shock damper that prevents the hatch door 310 from opening or closing too fast or moving unevenly. Further yet, there may be more than one guiding linkage 340 and any number may disposed at various locations, includinq inside the hold 305, outside the hold 305, within the top plane of the hold 305, etc.

Likewise, the hatch door 310 may be returned to the closed position in a similar, but opposite manner. The closing maneuver is also further assisted by the linkage arm 340 as it facilitates the sliding of the trailing edge 312 back across the plane at the top of the hatch 305.

In yet another embodiment, there may be one or more drive mechanisms (e.g., an electric or pneumatic motor) located at the coupling point 345 and operable to rotate the guiding linkage arm 340 when the actuator 330 is maneuvering the hatch door 310. By applying an additional force at the trailing edge 213 of the hatch door 310, the maneuvering of the hatch door 310 may be more easily accomplished and in a shorter amount of time. Such a drive mechanism may provide rotational movement or lateral movement, such as using a threaded telescoping guiding linkage arm 340.

While the subject matter discussed herein is susceptible to various modifications and alternative constructions, certain illustrated embodiments thereof are shown in the drawings and have been described above in detail. Furthermore, those skilled in the art will understand that various aspects described in less than all of the embodiments may, nevertheless, be present in any embodiment. It should be understood, however, that there is no intention to limit the subject matter to the specific forms disclosed, but on the contrary, the intention is to cover all modifications, alternative constructions, and equivalents falling within the spirit and scope of the subject matter disclosed.

What is claimed is:

1. A door assembly, comprising:

a frame configured to be disposed on a hold having an opening, the hold configured to launch a weapon; and a door disposed in the frame over the opening of the hold, the door rotatably attached to the frame at a first end of the door and slidably attached to the frame at a second opposite end of the door.

2. The door assembly of claim 1, further comprising an actuation point at the first end operable to be rotatably attached to an actuator for maneuvering the door.

3. The door assembly of claim 1 further comprising a seal for seating the door in the frame.

4. An apparatus, comprising:

a door configured to cover an opening of a hold and secured to the hold at a first end of the door; and an actuator having an actuator arm as a means for applying a force to open the door at a second end of the door such that the actuator arm is configured to extend to push open the door.

5. The apparatus of claim 4, wherein the actuator comprises one of the group including: an electrical actuator, a pneumatic actuator, a hydraulic actuator and a magnetic-energy actuator.

6. The apparatus of claim 4 wherein the opening is disposed in a plane over the top of the opening such that the first and second ends of the door are in the plane when the door is in a closed position.

7. The apparatus of claim 6 wherein the first end remains in the plane when the hatch door is maneuvered to an open position.

8. The apparatus of claim 4, further comprising a rotatable coupling point disposed between the door and the actuator arm.

9. A vertical launcher system, comprising:

a hold;

a hold door disposed over an opening of the hold and secured to the opening at a first end of the door; and an actuator having an actuator arm configured to apply a force to open the door at a second end of the door such that the actuator arm extends to push open the door.

10. The vertical launcher system of claim 9 disposed on one of the group comprising: a water vessel, an aircraft, and a land vehicle.

11. The vertical launcher system of claim 9 wherein the hold is operable for launching a device from the group comprising: a rocket, a missile, munitions, a drone aircraft, and a drone vessel.

12. The vertical launcher system of claim 9 wherein the first end is slidably fixed in a plane at the top of the hold.

13. The vertical launcher system of claim 9 wherein the hold door, secured by the actuator, is operable to withstand a force from at least one of the group comprising: wind drag, a missile plume, a water wave crash, external ballistics, and a gun blast.

* * * * *